US005078329A

United States Patent [19]

Grecksch et al.

[11] Patent Number: 5,078,329

[45] Date of Patent: Jan. 7, 1992

[54] PACKAGE DELIVERY ARRANGEMENT FOR AUTOMATIC YARN WINDING APPARATUS

[75] Inventors: Hans Grecksch, Mönchengladbach; Rene Bucken, Grefrath, both of Fed. Rep. of Germany

[73] Assignee: W. Schlafhorst & Co., Mönchengladbach, Fed. Rep. of Germany

[21] Appl. No.: 455,168

[22] Filed: Dec. 22, 1989

[30] Foreign Application Priority Data

Dec. 23, 1988 [DE] Fed. Rep. of Germany ..... 3843554

[51] Int. Cl.[5] ..... B65H 67/06

[52] U.S. Cl. ..... 242/35.50 A

[58] Field of Search ..... 242/35.5 A, 35.5 R, 242/18 R, 35.6 R

[56] References Cited

U.S. PATENT DOCUMENTS

| | | | |
|---|---|---|---|
| 4,544,107 | 10/1985 | Matsui et al. | 242/35.5 A |
| 4,545,551 | 10/1985 | Uchida et al. | 242/35.5 A |
| 4,566,644 | 1/1986 | Kiriake | 242/35.5 A |
| 4,634,066 | 1/1987 | Matsui et al. | 242/35.5 A |
| 4,685,630 | 8/1987 | Buhren et al. | 242/35.5 A |
| 4,781,334 | 11/1988 | Derichs | 242/35.5 A |

FOREIGN PATENT DOCUMENTS

| | | |
|---|---|---|
| 3326000 | 1/1984 | Fed. Rep. of Germany . |
| 3338857 | 5/1984 | Fed. Rep. of Germany . |
| 3431790 | 3/1985 | Fed. Rep. of Germany . |
| 3622004 | 3/1987 | Fed. Rep. of Germany . |

*Primary Examiner*—Stanley N. Gilreath

*Attorney, Agent, or Firm*—Shefte, Pinckney & Sawyer

[57] ABSTRACT

An automatic yarn winding apparatus includes plural aligned winding stations and a delivery conveyor extending along the winding stations for supplying thereto yarn packages comprising yarn tube support members carrying fully wound yarn tubes. The delivery conveyor is driven alternately in opposite directions. Package entrance conveyors supply yarn packages to the delivery conveyor at least two spaced locations therealong. Switchable mechanisms are provided for selectively forming and removing at least one package barrier along the delivery conveyor between the entrance locations for preventing package movement therebeyond. By provision of additional package entrance conveyors and package barrier mechanisms, the delivery conveyor can be effectively divided into multiple transport sections for respectively supplying differing groups of the winding stations with differing respective groups of yarn packages.

10 Claims, 2 Drawing Sheets

PACKAGE DELIVERY ARRANGEMENT FOR AUTOMATIC YARN WINDING APPARATUS

BACKGROUND OF THE INVENTION

The present invention relates to automatic bobbin winding apparatus and, more particularly, to such apparatus of the type having a plurality of aligned winding stations with a traveling conveyor belt or other package delivery assembly extending along the winding stations for supplying thereto packages consisting of yarn tube support members carrying fully wound yarn tubes.

Conventional automatic yarn winding apparatus of the aforementioned type are not readily capable of handling at the same time two or more differing groups of supply packages, e.g., packages carrying yarns of differing types. In such cases, a group of the winding stations at the rearward end of the winding apparatus, i.e., viewed in the direction of package delivery by the conveyor belt or other package delivery assembly, are designated for handling one group of yarn packages which are fed manually to the designated group of winding stations while the conveyor belt or other package delivery assembly is utilized for automatic feeding of the other group of yarn packages to the other winding stations of the apparatus.

In principle, it is also possible in an automatic yarn winding apparatus of the aforementioned type to utilize the conveyor belt or other package delivery assembly to supply differing groups of yarn packages to differing corresponding groups of the winding stations by individually performing at differing times the package delivery operation for each differing group of yarn packages to the associated group of winding stations. Disadvantageously, however, this manner of operation with differing groups of yarn packages generally causes delays in the delivery of at least some of the yarn packages to the associated winding stations. Such delays can be avoided by providing a sufficiently increased package storage capacity at each individual winding station, but this technique creates the alternative disadvantage that changes in the types of yarn packages being supplied to each winding station cannot be accomplished until all of the yarn packages stored at each winding station have been depleted, thereby hindering the desired ability of the winding apparatus to accomplish quick changes in the types of yarn packages.

Another possibility for enabling differing groups of yarn packages to be processed on differing winding stations of the same automatic winding apparatus is to provide a sufficiently sophisticated control system to transmit package request signals from each group of winding stations or each individual winding station when a package is needed and to insure that each individual package fed by the conveyor belt or other package delivery system is properly delivered to the signaling group of winding stations or the signaling individual winding station. Control systems of this type, however, are relatively expensive and also are subject to periodic breakdowns. For such reasons, such control systems normally are not considered for use in an automatic winding apparatus which is unmonitored by operating personnel.

West German Offenlegungsschrift DE 36 22 004 discloses an automatic winding apparatus having plural aligned winding sections each of which includes several winding stations. A primary conveyor extends along the length of the winding apparatus for transporting fully wound yarn tubes for supply to the winding sections and their individual winding stations. Each winding section further includes an individual secondary supply conveyor for delivering wound yarn tubes to the individual winding stations, each winding section including a controllable transfer device for selectively diverting yarn tubes from the primary conveyor to the secondary conveyor of the respective winding section for supply to its individual winding stations. The primary and secondary conveyors in this apparatus are preferably in the form of conveyor belts and the transfer devices are preferably in the form of controllable shunts. Disadvantageously, however, this apparatus is also relatively expensive and is not readily capable of flexible or changeable operation.

SUMMARY OF THE INVENTION

It is accordingly an object of the present invention to provide an inexpensive system by which the multiple yarn winding stations of an automatic textile yarn winding apparatus can be selectively subdivided quickly and easily into varying numbers of groups of varying numbers of individual stations per group and by which differing corresponding groups of yarn packages can be reliably supplied to the differing groups of winding stations.

Briefly summarized, the present invention provides an automatic yarn winding apparatus having a plurality of aligned winding stations and a package delivery assembly extending along the winding stations for supplying thereto packages each of which includes a yarn tube support member carrying a fully wound yarn tube. A drive system is provided for driving the package delivery assembly alternately in opposite directions along the winding stations and a mechanism is provided for placing yarn packages onto the package delivery assembly at at least two spaced entrance locations therealong. Another arrangement is provided for selectively forming and removing a barrier along the package delivery assembly between the spaced entrance locations for preventing movement therebeyond of the packages with the package delivery assembly. In this manner, the package delivery assembly may be selectively divided by the barrier arrangement into two individual package transporting sections.

As will be understood, the positioning and the size of the particular subdivided package transporting sections of the package delivery assembly is determined by the particular arrangement of the spaced package entrance locations and the barrier. Furthermore, by providing multiple package entrance locations along the length of the package delivery assembly and multiple barrier arrangements therebetween, greater flexibility is achieved in the number and size of package transporting sections into which the package delivery assembly may be subdivided. In each case, each package transporting section of the package delivery assembly may be utilized for supplying a differing group of yarn packages to a respective group of the winding stations. By alternately reversing the direction of movement of the package delivery assembly along the winding stations, the same package delivery assembly is enabled to convey each differing group of yarn packages at the same time to the respective winding stations associated with each subdivided package transporting section. When one or more of the winding stations is fully supplied with yarn packages, any remaining yarn packages on the package delivery assembly which cannot be taken up by the winding station or stations remain on the package delivery assembly and are transported back and forth therealong between the barriers defining the ends of the respective package transporting section. Preferably, the package delivery assembly is in the form of a traveling conveyor belt on which the individual yarn packages are supported. Thus, when a yarn package encounters a barrier, relative sliding movement occurs between the yarn package and the conveyor belt whereby continuing traveling movement of the conveyor belt is unaffected. Accordingly, no particular attention need be paid in placing yarn packages onto the package delivery assembly as to whether the respective package transport section still carries previously supplied yarn packages.

In the preferred embodiment of the present invention, at least one entrance location is provided at one end of the yarn package delivery assembly for placement of yarn packages thereonto, which can be particularly advantageous in cases wherein the package delivery assembly is intermittently or predominantly operated to a greater degree in one direction than the opposite direction.

According to another feature of the present invention, at least one entrance location is provided intermediate two adjacent winding stations for placement of yarn packages onto the package delivery assembly thereat. By this arrangement, a relatively shortened package transporting section of the package delivery assembly can be achieved, which is particularly advantageous when differing smaller groups of yarn packages are to be frequently processed.

It will also be recognized to be possible and even advantageous to provide package entrance locations at each opposite end of the package delivery assembly and at one or more spaced locations therebetween. In each case, the number of operable package entrance locations necessary must be determined. On the other hand, automatic winding apparatus incorporating the present invention may be readily equipped at a later time with additional yarn entrance locations and additional barrier arrangements as needed or desired.

According to the present invention, a barrier arrangement may be provided between each adjacent pair of the winding stations. In this manner, optimal flexibility is achieved for subdividing the package delivery assembly with respect to varying groups and numbers of the winding stations.

In the embodiments of the winding apparatus in which the number of differing groups of winding stations and the number of winding stations per group is determined in advance, barrier arrangements need by provided only intermediate the winding stations of differing sections and preferably also at the opposite ends of the package transport assembly, which enables the technical expense of the apparatus to be kept to a minimum.

A selectively operable barrier arrangement may be provided at at least one end of the package transport assembly, which is especially advantageous when the package transport assembly is occasionally operated empty. Otherwise, it would be sufficient to provide stationary barriers or, alternatively, package entrance locations at the same position at the end or ends of the package transport assembly.

According to another feature of the present invention, a plurality of secondary package delivery assemblies are provided, each being associated with a respective one of the winding stations and associated with the primary package delivery assembly for automatically diverting packages therefrom when the associated winding station has a package vacancy. In this manner, each winding station takes a yarn package from the primary package delivery assembly completely automatically as the winding station requires new yarn packages. If the winding station is fully supplied with yarn packages, yarn packages on the primary package delivery assembly automatically bypass the winding station and continue to be transported by the primary package delivery assembly to the next winding station having a package vacancy.

DESCRIPTION OF THE PREFERRED EMBODIMENT

Referring now to the accompanying drawings, an automatic yarn winding apparatus according to the preferred embodiment of the present invention is indicated in its entirety at 39. For sake of simplicity, the winding apparatus 39 is illustrated as comprising only five winding stations 40, 41, 42; 43, 44, of which winding station 42 is shown representatively in FIG. 1.

Figure 1:
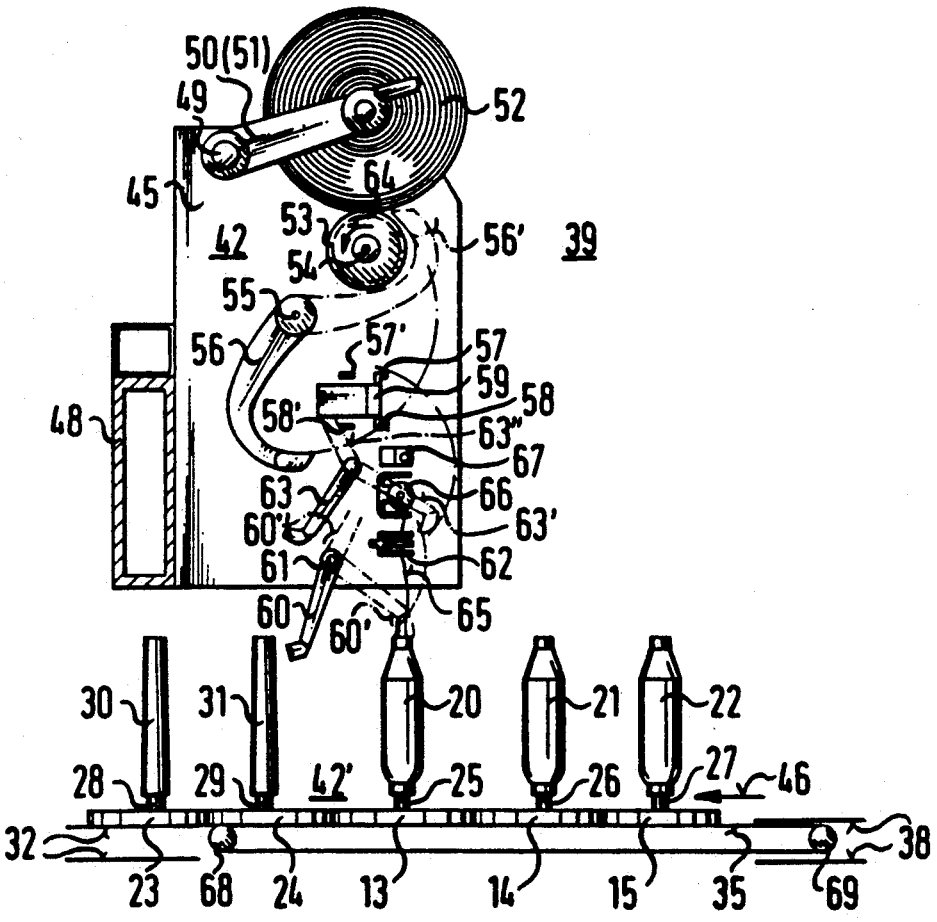
FIG. 1 is a schematic side elevational view of one winding station of an automatic winding apparatus according to the preferred embodiment of the present invention.

Each of the winding stations is of substantially the same construction and operation as the winding station 42 in FIG. 1. Basically, each winding station includes a housing 45 containing the operational components of the winding station, with the housing 45 being affixed to a longitudinal frame member 48 extending the length of the winding apparatus between a pair of end frame members (not shown) located at opposite ends of the winding apparatus. Each winding station includes a creel 50, 51, one end 49 of which is pivotably mounted to the housing 45 with the opposite end rotatably supporting a tubular yarn-winding core about which yarn is cross-wound to produce a bobbin 52. The creel 50, 51 supports the bobbin 52 in peripheral engagement with a winding roller 53 having an axial shaft 54 which is rotatably supported by the housing 45 and driven by a drive mechanism (not shown) also supported within the housing 45.

Each winding station additionally includes a yarn piecing mechanism which includes a first suction tube 56 pivotably mounted to the housing 45 about a pivot axis 55 for movement between the position shown at 56' in broken lines in FIG. 1, wherein the free end of the suction tube 56 is situated adjacent the nip area between the winding roller 53 and the bobbin 52 to engage by suction a free trailing yarn end on the surface of the bobbin 52, and the position shown in full lines in FIG. 1 wherein the suction tube 56 presents the located yarn end to a set of feeding arms 57, 58 of an automatic yarn-splicing device 59. A second suction tube 60 is pivotably mounted to the housing 45 at 61 for rotational movement through a full 360° range of movement. When rotated to be situated in the disposition shown at 60', the free end of the suction tube 60 is located adjacent the upper end of a yarn tube 20 disposed in active unwinding operation at the unwinding position 42' of the winding station 42, whereat the suction tube 60 can locate by suction a free leading end of yarn on the tube 20. From the position 60', the suction tube 60 can be moved into a more rotated position shown at 60'' in FIG. 1 whereat the suctioned yarn end is placed into a comb feeler 62, the suction tube 60 automatically releasing the yarn end as it continues to rotate beyond the position 60' to return to its original starting position. A third suction tube 63 is pivotably mounted to the housing 45 directly above the suction tube 60 for similar movement through a full 360° range of motion. The resting position of the suction tube 63 is shown in full lines in FIG. 1, from which the suction tube 63 can move into a yarn suctioning position shown in broken lines at 63', wherein the suction tube 63 takes up by suction the yarn end held by the comb feeler 62. From the position 63', the suction tube 63 rotates further into a delivery position shown in broken lines at 63'', wherein the suction tube 63 presents the yarn end to the feeder arms 57, 58 of the yarn splicing device 59. The feeder arms 57, 58 are arranged for lateral movement into respective positions indicated at 57', 58', wherein the yarn ends previously presented to the feeder arms 57, 58 are inserted into the yarn splicing device 59, which in turn is adapted to produce a spliced connection of the two yarn ends in a conventional manner. In this manner, the yarn from multiple yarn tubes successively brought to the unwinding position 42' of the winding station can be wound as one continuous length onto the bobbin 52. Likewise, in the event of a breakage of the yarn during the winding operation, the broken yarn ends can be located and pieced together to enable the winding operation to continue. During any such winding operation, the winding roller 53 is stopped. Upon completion of the splicing operation, the drive to the winding roller 53 is restarted, whereupon the winding roller 53, operating in the direction of the arrow 64, causes the yarn, indicated at 65, to be continuously unwound and drawn upwardly from the yarn tube 20, through the comb feeler 62, a yarn brake 66, and a measuring slot of a yarn cleaner 67, to the nip area between the winding roller 53 and the bobbin 52 whereat the yarn is applied to and wound about the bobbin 52.

As illustrated in FIG. 1, each successive yarn tube presented to the winding station for unwinding of yarn therefrom is supported on a yarn tube support member, e.g., support member of the yarn tube 20 at the unwinding position 42', which has a substantially flat, circular, disk-like body from which a pin, e.g., the pin 25 of the support member 13, extends coaxially for insertion centrally into the yarn tube for securely supporting the yarn tube in an upright disposition. At the winding station 42 in FIG. 1, the yarn tube 20, as already mentioned, is disposed in unwinding operation at the unwinding station 42 directly beneath the described operational components of the winding station 42. Two other yarn tubes 21, 22 are arranged in successive following relation to the winding tube 20 on the respective pins 26, 27 of support members 14, 15, to be delivered in series to the unwinding position 42' after unwinding of the tube 20 is completed. As also shown in FIG. 1, a pair of empty yarn tubes 30, 31 are shown in advance of the active yarn tube 20 on the respective pins 28, 29 of support members 23, 24, yarn from these tubes 30, 31 having been unwound at the unwinding position 42' immediately in advance of the active yarn tube 20.

Figure 2:
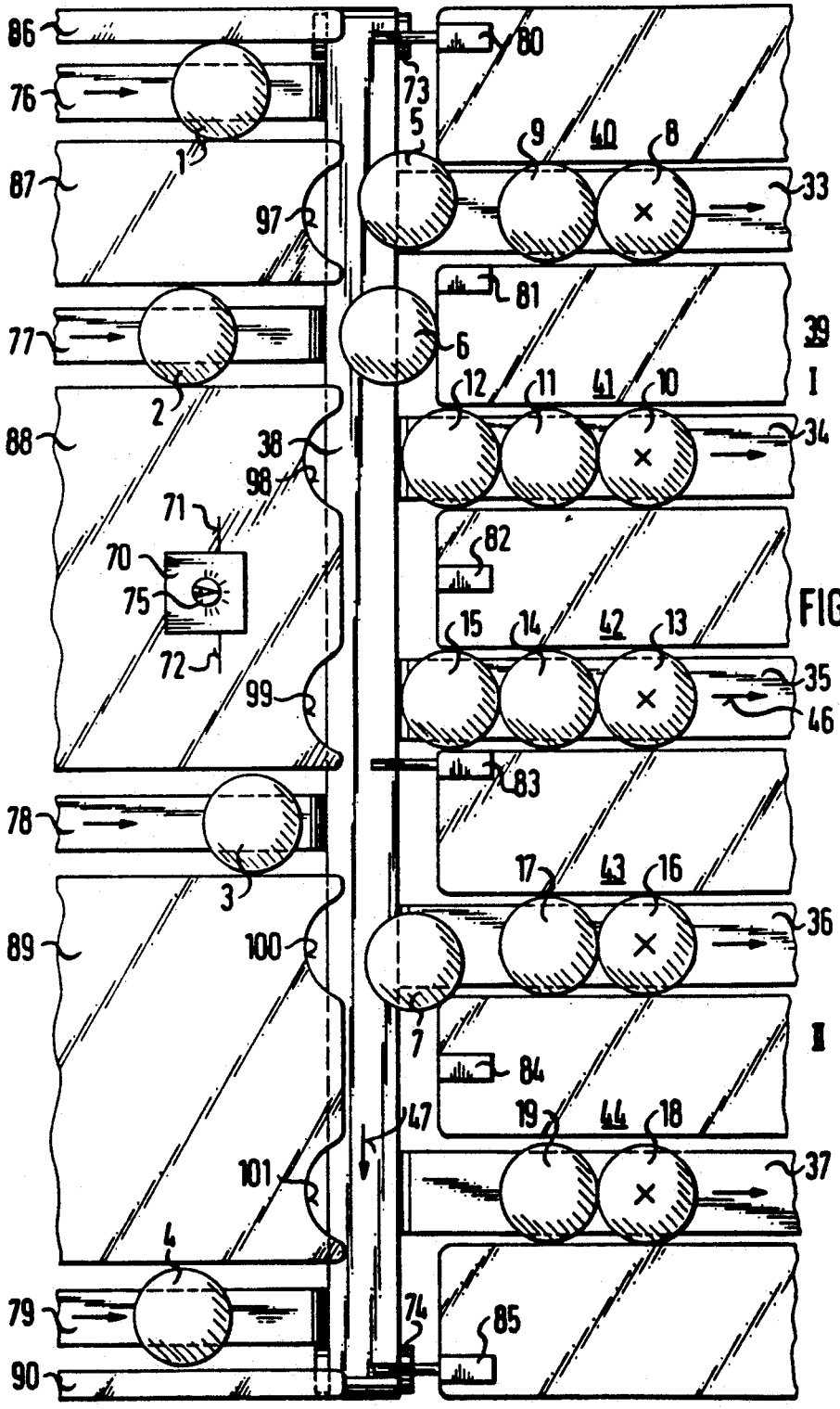
FIG. 2 is a schematic top plan view of several successive winding stations of the yarn winding apparatus of FIG. 1.

Each winding station 40, 41, 42, 43, 44 is provided with an associated driven conveyor belt 33, 34, 35, 36, 37, on which yarn tube support members carrying fully wound yarn tubes may be supported as individual packages for transporting the yarn tubes in succession to and from the unwinding position of the associated winding station for yarn unwinding operation in the manner above-described. Thus, in FIG. 1, the conveyor belt 35 for the winding station 42 is shown as transporting the yarn tube support members 23, 24, 13, 14, 15 and their respective yarn tubes 30, 31, 20, 21, 22 on the upper run of the conveyor belt 35 in its direction of travel 46 for serial delivery to the unwinding position 42' of the winding station 42. As indicated in FIG. 2, each of the conveyor belts 33, 34, 35, 36, 37 extends at its respective winding station 40, 41, 42, 43, 44 transversely with respect to the longitudinal arrangement of the winding stations along the length of the winding apparatus from a package delivery assembly 38, preferably in the form of a conveyor belt, extending along the length of the winding apparatus at one side thereof to a package discharge assembly 32 (FIG. 1), preferably also in the form of a conveyor belt, extending along the length of the winding apparatus at the opposite side thereof. Each of the transverse conveyor belts 33, 34, 35, 36, 37 operates continuously in the direction of the respective arrows shown in FIG. 2. Using the conveyor belt 35 associated with the winding station 42 as an example, the belt 35 is trained about a pair of spaced belt guide rollers or pulleys 68, 69, one of which is continuously driven by a drive motor (not shown), while the other serves as an idler roller or pulley, as shown in FIG. 1. A stop mechanism, e.g., a switchable stop arm, is provided at the unwinding position along the conveyor belt 33, 34, 35, 36, 37 of each winding station 40, 41, 42, 43, 44 to prevent each yarn package support member delivered in succession to the unwinding position from being transported by the conveyor belt beyond the unwinding position until all yarn from the supported yarn tube has been unwound. In turn, the stop mechanism causes successively delivered packages of yarn tube support members carrying fully wound yarn tubes to accumulate behind the active yarn tube in unwinding operation at the unwinding position. Thus, each conveyor belt 33, 34, 35, 36, 37 also functions simultaneously in the fashion of a magazine for storing a supply of yarn tubes to be placed into unwinding operation upon exhaustion of yarn from the active yarn tube in advance thereof. In the illustrated embodiment, each conveyor belt is capable of holding two yarn tube packages in reserve adjacent to the active yarn tube in unwinding operation at the associated winding station, as shown in each of FIGS. 1 and 2. In FIG. 2, the unwinding position of each winding station is indicated by the respective package support members 8, 10, 13, 16, 18, each marked with a "X".

The conveyor belt of the package delivery assembly 38 operates to deliver yarn tube packages to the individual conveyors 33, 34, 35, 36, 37 for supply to each respective winding station. The conveyor belt 38 is trained about the driven external rotors or pulleys of a pair of electric motors 73, 74 of the so-called band or belt motor type, each of which is operatively connected at 71, 72, respectively, to a control device 70, preferably in the form of a switching device, by which the motors 73, 74 can be selectively switched at an adjustable predetermined time interval set by an adjustment knob 75 to alternately drive the conveyor belt 38 in opposite directions. For example, when the belt motor 74 is operative to drive the conveyor belt 38, the upper run of the conveyor belt travels in the direction of the arrow 47. On the other hand, when the belt motor 73 is actuated to drive the conveyor belt 38, the upper run of the belt 38 travels in the opposite direction.

In the illustrated embodiment, yarn tube packages, representatively indicated at 1, 2, 3, 4, may be delivered to and placed on the upper run of the conveyor belt 38 at four differing entrance locations 76, 77, 78, 79 spaced along the length of the conveyor belt 38. Preferably, an individual conveyor belt is arranged at each entrance location transversely with respect to the length of the conveyor belt 38 to deliver yarn tube packages thereto and thereby define the entrance locations. Each such package entrance conveyor 76, 77, 78, 79 travels in the direction of the arrows shown in FIG. 2, and may be operated continuously or only intermittently when yarn tube packages are being supplied.

The package entrance conveyor at the entrance location 76 and the package entrance conveyor at the entrance location 79 are positioned at the opposite ends of the conveyor belt 38, while the package entrance conveyor at the entrance location 77 is positioned along the cooperative length of the conveyor belt 38 between the winding stations 40, 41 and the package entrance conveyor at the entrance location 78 is similarly positioned between the winding stations 42, 43.

According to the present invention, several individually actuable barrier mechanisms 80, 81, 82, 83, 84, 85 are positioned at spacings to one another along the conveyor belt 38 of the package delivery assembly, each barrier mechanism basically including a barrier arm which can be selectively extended into and retracted from a position extending across the upper run of the conveyor belt 38 to block movement of yarn tube packages on the conveyor belt 38. The barrier mechanism 80 is located at one end of the conveyor belt 38 inwardly adjacent the package entrance location 76, while the barrier mechanism 85 is similarly situated at the opposite end of the conveyor belt 38 inwardly adjacent the package entrance location 79. The remaining barrier mechanisms 81, 82, 83, 84 are arranged at spacings along the conveyor belt 38 between each adjacent pair of the winding stations 40, 41, 42, 43, 44. In this manner, when each of the barrier mechanisms is extended, each package entrance location 76, 77, 78, 79 is isolated for feeding yarn tube packages to only a single associated winding station 40, 41, 43, 44, respectively, with the winding station 42 being isolated from any package entrance location and therefore out of operation. On the other hand, by actuation of only selected ones of the barrier mechanisms, or alternatively by the provision and selective placement of a lesser number of barrier mechanisms, the winding stations can be segregated into groups each of two or more winding stations with each group of winding stations associated with one or more package entrance locations. Thus, for example, by selective extension of only the barrier mechanisms 80, 83, 85 as shown in FIG. 2, the winding stations can be divided into two groups, Group I including the winding stations 40, 41, 42 supplied with yarn tube packages from the conveyors at the entrance locations 76, 77, and Group II including the winding stations 43, 44 supplied with yarn tube packages from the conveyors at the entrance locations 78, 79.

As will thus be understood, the winding stations 40, 41, 42, 43, 44 can be selectively segregated into two or more differing groups each associated with a respective one or more package entrance conveyor location, whereby each group of winding stations can be utilized for processing differing yarns. Assuming the winding stations 40, 41, 42, 43, 44 are segregated into Groups I and II as above-described, the present winding apparatus may be operated in the following manner. The entrance conveyor at the yarn tube package entrance location 77 is utilized for supplying yarn tube packages to winding stations 40, 41, 42 of Group I, while the entrance conveyor associated with the yarn tube package entrance location 78 is operated for supplying yarn tube packages to the winding stations 43, 44 of Group II. The entrance conveyors associated with the yarn tube package entrance locations 76, 79 are deactuated to be out of operation. As is typical, the average speed and elapsed time at which yarn is unwound from each individual yarn tube at each individual winding station varies, resulting among other things from sporadically occurring yarn breakages. The conveyors 33, 34, 35, 36, 37 of the respective winding stations 40, 41, 42, 43, 44 are driven at a greater traveling speed than the relatively slowly moving conveyor belt 38 of the package delivery assembly. The time intervals at which the belt motor 73, 74 associated with the conveyor belt 38 are alternately operated is set at the control unit 70 to correspond to the time period required for the conveyor belt 38 to transport a yarn package from engagement with the barrier mechanism 80 into engagement with the barrier mechanism 83 when the conveyor belt 38 is operated in the direction of the arrow 47 and the corresponding time period required for the conveyor belt 38 to transport a yarn package from engagement with the barrier mechanism 83 into engagement with the barrier mechanism 80 when the conveyor belt 38 is operated in the direction opposite to the arrow 47. Thus, the conveyor belt 38 travels alternatingly back and forth in opposite directions.

As shown in FIG. 2, yarn packages 5, 6, 7 are supported on and transported by the conveyor belt 38. The yarn packages 1, 4 supported on the entrance conveyors at the package entrance locations 76, 79 are at rest since the conveyors are out of operation as aforementioned. On the other hand, the yarn tube packages 2, 3 being transported by the entrance conveyors at the package entrance locations 77, 78 are shortly approaching the conveyor belt 38. Guide members 86, 87, 88, 89, 90 are situated along the side of the conveyor belt 38 opposite the winding stations and intermediate the package entrance conveyors 76, 77, 78, 79 to laterally guide each individual yarn tube package during travel along the entrance conveyors 76, 77, 78, 79 and at one lateral side during travel along the conveyor belt 38 of the package delivery assembly. Specifically, as shown in FIG. 2, the guide members 86, 87, 88, 89, 90, partially overlap the lateral side of the conveyor belt 38 opposite the winding stations sufficiently to displace yarn packages on the conveyor belt 38 toward the winding stations such that a portion of each yarn package extends laterally from the conveyor belt 38 sufficiently to be engaged by a supply conveyor belt 33, 34, 35, 36, 37, as represented by the yarn package 6 in FIG. 2. The guide members 87, 88, 89 are further provided with recessed regions 97, 98, 99, 100, 101 disposed directly opposite the conveyor belts 33, 34, 35, 36, 37 associated with the individual winding stations 40, 41, 42, 43, 44, each recessed region functioning to provide sufficient space for yarn packages to be deflected laterally on the conveyor 38 by the last yarn package on a full supply conveyor to enable yarn packages to continue to travel with the conveyor 38 past the respectively associated winding station when its supply conveyor is fully occupied by yarn packages to be unwound, e.g., the winding stations 41, 42 in FIG. 2.

As will therefore be recognized in FIG. 2, the winding stations 41, 42 have no present need for any yarn tube package. Further, while each of winding stations 40 and 43 has a vacancy for a single yarn tube package, the vacancy in each case is in the process of being immediately fulfilled, the yarn tube package 5 already having been engaged by the supply conveyor 33 associated with the winding station 40 to therefore shortly come to rest in contact with the next preceding yarn tube package 9 thereon and, likewise, the yarn tube package 7 having already been engaged by the conveyor 36 associated with the winding station 43 to shortly come to rest in contact with the next preceding yarn package 17 thereon. The winding station 44 has a vacancy for a single yarn tube package, which will be satisfied once the yarn tube package 3 on the entrance conveyor 78 is delivered onto the conveyor belt 38 and transported thereby in the direction of the arrow 47 to the supply conveyor 37 associated with the winding station 44.

Once the package vacancies at all of the winding stations have been fulfilled, any additional yarn tube packages delivered onto the conveyor belt 38 remain thereon in a serial arrangement and are transported back and forth along the respective sections of the belt 38 defined by the barrier mechanisms 80, 83, 85 until package vacancies open at the associated winding stations, whereupon each yarn package automatically is taken from the conveyor belt 38 by the individual winding station supply conveyor or conveyors having a vacancy. As will be understood, since the winding station supply conveyors 33, 34, 35, 36, 37 travel at a relatively greater speed than the relatively slowly traveling conveyor belt 38, the supply conveyors automatically divert and withdraw available yarn tube packages from the delivery conveyor belt 38 as the packages reach the supply conveyors. Thus, no deleterious complications result from delivery of yarn packages onto the conveyor belt 38 when the winding stations are full.

While the operation of the winding apparatus in FIG. 2 has been described above as assuming the package entrance conveyors 76, 79 to be out of operation, it will of course be understood by those persons skilled in the art that the winding apparatus could be operated equally well with the package entrance conveyors 76, 79 in operation and the entrance conveyors 77, 78 out of operation or, alternatively, with three or all four of the entrance conveyors in operation.

To prevent any undesired sagging or deflection of the upper runs of the various conveyor belts operating in the present apparatus, a support or carrier surface is disposed immediately beneath the upper run of each individual conveyor. Further, as shown in FIG. 1, the respective guide pulleys about which travel the several winding station supply conveyor belts 33, 34, 35, 36, 37 and the package entrance conveyor belts 76, 77, 78, 79 are situated between the upper and lower runs of the package delivery conveyor belt 38 and, accordingly, are not visible in FIG. 2. This arrangement assures a stable and reliable transition of package travel from one conveyor belt to another.

As will be understood, the conveyor belt 38 can be cleared of all yarn tube packages at any time during operation by simply withdrawing the barrier mechanisms 80, 85, thereby allowing yarn packages on the conveyor belt 38 to be discharged therefrom.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. Apparatus for automatically winding yarn from one yarn tube onto another, comprising a plurality of aligned winding stations, a package delivery assembly extending along said winding stations for transporting to said winding stations packages comprising yarn tube support members carrying fully wound yarn tubes for unwinding, means for driving said package delivery assembly alternately in opposite directions along said winding stations, means for placing said packages-onto said package delivery assembly at at least two spaced entrance locations therealong, means for selectively forming and removing a barrier along said package delivery assembly between said spaced entrance locations for preventing movement therebeyond of said packages with said package delivery assembly, thereby for selectively dividing said package delivery assembly into two package transporting sections.

2. Apparatus for automatically winding yarn from one yarn tube onto another according to claim 1 and characterized further in that one said entrance location is at one end of said package delivery assembly.

3. Apparatus for automatically winding yarn from one yarn tube onto another according to claim 1 and characterized further in that one said entrance location is intermediate two adjacent winding stations.

4. Apparatus for automatically winding yarn from one yarn tube onto another according to claim 1 and characterized further in that one said barrier means is arranged between each adjacent pair of winding stations.

5. Apparatus for automatically winding yarn from one yarn tube onto another according to claim 1 and characterized further in that at least three said barrier means are arranged along said package transport assembly at spacings each from the other encompassing plural adjacent winding stations, thereby for effectively dividing said winding stations into at least two groups each of plural winding stations.

6. Apparatus for automatically winding yarn from one yarn tube onto another according to claim 1 and characterized further by another said barrier means arranged at one end of said package delivery assembly.

7. Apparatus for automatically winding yarn from one yarn tube onto another according to claim 1 and characterized further by a plurality of secondary package delivery assemblies, each associated with a respective one of said winding stations and associated with said first-mentioned package delivery assembly for automatically diverting packages therefrom when the associated winding station has a package vacancy.

8. Apparatus for automatically winding yarn from one yarn tube onto another, comprising a plurality of aligned winding stations, a package delivery assembly extending along said winding stations for transporting to said winding stations packages comprising yarn tube support members carrying fully wound yarn tubes for unwinding, means for driving said package delivery assembly alternately in opposite directions along said winding stations, means associated with said package delivery assembly for distributing said packages among said winding stations as said package delivery assembly is driven in opposite directions, and means for placing said packages onto said package delivery assembly at at least one entrance location therealong.

9. Apparatus for automatically winding yarn from one yarn tube onto another, comprising a plurality of aligned winding stations, a package delivery assembly extending along said winding stations for transporting to said winding stations packages comprising yarn tube support members carrying fully wound yarn tubes for unwinding, means for driving said package delivery assembly alternately in opposite directions along said winding stations, means for placing said packages onto said package delivery assembly at at least one entrance location therealong, and means forming a barrier at each end of said package delivery assembly for preventing movement therebeyond of said packages with said package delivery assembly.

10. Apparatus for automatically winding yarn from one yarn tube onto another according to claim 8 and characterized further by said distributing means including a plurality of secondary package delivery assemblies, each associated with a respective one of said winding stations and associated with said first-mentioned package delivery assembly for automatically diverting packages therefrom when the associated winding station has a package vacancy.

* * * * *